United States Patent [19]

Kobayashi et al.

[11] Patent Number: 4,979,996

[45] Date of Patent: Dec. 25, 1990

[54] PROCESS FOR PREPARATION OF GRAIN-ORIENTED ELECTRICAL STEEL SHEET COMPRISING A NITRIDING TREATMENT

[75] Inventors: Hisashi Kobayashi; Katsuro Kuroki; Masayoshi Minakuchi; Kenichi Yakashiro, all of Kitakyushu, Japan

[73] Assignee: Nippon Steel Corporation, Tokyo, Japan

[21] Appl. No.: 340,240

[22] Filed: Apr. 19, 1989

[30] Foreign Application Priority Data

Apr. 25, 1988 [JP] Japan ..... 63-100111
Apr. 13, 1989 [JP] Japan ..... 1-91956

[51] Int. Cl.[5] ..... H01F 1/04
[52] U.S. Cl. ..... 148/111; 148/113
[58] Field of Search ..... 148/111, 112, 113

[56] References Cited

U.S. PATENT DOCUMENTS 4,473,416 9/1984 Kawamo et al. ..... 148/111

FOREIGN PATENT DOCUMENTS 40-15644 7/1965 Japan .
47-25250 7/1972 Japan .
52-24116 2/1977 Japan .
59-190324 11/1984 Japan .
61-60896 12/1986 Japan .
62-45285 2/1987 Japan .

*Primary Examiner*—Melvyn J. Andrews
*Attorney, Agent, or Firm*—Kenyon & Kenyon

[57] ABSTRACT

The present invention relates to an improvement in the technique of heating an electrical steel slab at a low temperature. A grain-oriented electrical steel sheet having excellent magnetic characteristics and film characteristics is prepared by the process characterized in that a slab comprising, as main ingredients, up to 0.012% by weight of S, 0.010 to 0.060% by weight of acid-soluble Al, up to 0.010% by weight of N, 0.08 to 0.45% by weight of Mn, and 0.015 to 0.045% by weight is used as the starting slab, and after the decarburization annealing, the nitriding treatment is carried out at a temperature of 500° to 900° C. in an atmosphere having an $NH_3$ gas concentration of at least 1000 ppm, while running the strip.

5 Claims, 3 Drawing Sheets

PROCESS FOR PREPARATION OF GRAIN-ORIENTED ELECTRICAL STEEL SHEET COMPRISING A NITRIDING TREATMENT

BACKGROUND OF THE INVENTION (1) Field of the Invention

The present invention relates to a process for the preparation of an grain-oriented electrical steel sheet having excellent magnetic and film characteristics. More particularly, the present invention relates to a process in which the temperature for heating an electrical steel slab is lowered and the productivity is increased.

(2) Description of the Prior Art

A grain-oriented electrical steel sheet is used mainly as a core material for transformers, generators and other electric appliances, and this electrical sheet must have not only good magnetic characteristics such as good exciting and watt loss characteristics but also good film characteristics.

The grain-oriented electrical steel sheet is obtained by growing crystal grains having a Goss structure, having the {110} plane in the rolled plane and the <001> axis in the rolling direction, by utilizing the phenomenon of secondary recrystallization.

As is well known, the phenomenon of secondary recrystallization occurs during the finish annealing step, and to manifest a good secondary recrystallization, a fine precipitate of an inhibitor such as AlN, MnS or MnSe, which inhibits the growth of primary recrystallization grains at temperatures below the secondary recrystallization-manifesting temperature region during the finish annealing step, must be present in the steel. Accordingly, an electrical steel slab is heated at a temperature as high as 1350° to 1400° C. to completely solid-dissolve inhibitor-forming elements such as Al, Mn, S, Se and N, and the inhibitor elements completely solid-dissolved in the steel are finely precipitated in the form of AlN, MnS or MnSe by annealing in the hot-rolled sheet or in the stage of the intermediate thickness before the final cold rolling.

If this process is adopted, since the electrical steel slab is heated at a high temperature as mentioned above, the frequency of repairs necessary for the heating furnace is increased, resulting in increase of the maintenance costs, a reduction of the operating efficiency of the equipment, and an increase of the fuel unit.

To solve this problem, research and investigation have been made into a process for preparing a grain-oriented electrical steel sheet while lowering the temperature for heating an electrical steel slab.

For example, Japanese Unexamined Patent Publication No. 52-24116 proposes a preparation process in which the temperature for heating an electrical steel slab is lowered to 1100° to 1260° C. by incorporating a nitride-forming element, such as Al and Zr, Ti, B, Nb, Ta, V, Cr or Mo, in the steel.

Furthermore, Japanese Unexamined Patent Publication No. 59-190324 proposes a process in which the C content is kept below 0.01%, an electrical steel slab in which S, Se, Al and B are selectively included is used as the starting material, and pulsation annealing is effected by repeatedly heating the surface of the steel sheet at a high temperature for a short time at the primary recrystallization annealing conducted after the cold rolling, whereby the temperature for heating the electrical slab can be made lower than 1300° C.

Moreover, Japanese Examined Patent Publication No. 61-60896 proposes a preparation process in which an electrical steel slab wherein the Mn content is adjusted to 0.08 to 0.45% and the S content is kept below 0.007% to lower the [Mn][S] product, and Al, P and N are incorporated, is used as the staring material, whereby the temperature for heating the slab can be made lower than 1280° C.

Where grain-oriented electrical steel sheets are prepared according to these prior art techniques, however, defects such as "frosting" and "bear spots" are often formed on glass films of the final products.

SUMMARY OF THE INVENTION

A primary object of the present invention is to provide a process for preparing a grain-oriented electrical steel sheet while controlling the temperature for heating an electrical steel slab to a level lower than 1200° C., in which an electrical steel sheet having excellent magnetic characteristics can be manufactured stably, at a high productivity, and on an industrial scale.

Another object of the present invention is to provide an electrical steel sheet not having defects such as "frosting" on a glass film of the final product.

In the present invention, these objects can be attained by the process having the following construction.

Namely, the present invention provides a process for preparing a grain-oriented electrical steel sheet while controlling the temperature for heating an electrical steel slab to a level lower than 1200° C., in which an inhibitor composed mainly of (Al,Si)N is formed by a novel technique of nitriding a running steel sheet to compensate for an insufficient solid dissolution of AlN during the low-temperature heating of the slab, whereby an electrical steel sheet having excellent magnetic characteristics is prepared.

More specifically, in accordance with the present invention, there is provided a process for the preparation of a grain-oriented electrical steel sheet having excellent magnetic and film characteristics, which comprises heating an electrical steel slab comprising 0.025 to 0.075% by weight of C, 2.5 to 4.5% by weight of Si, up to 0.012% by weight of S, 0.010 to 0.060% by weight of acid-soluble Al, up to 0.010% by weight of N, 0.08 to 0.45% by weight of S, and 0.015 to 0.045% by weight of P, with the balance consisting of Fe and unavoidable impurities, at a temperature lower than 1200° C., hot-rolling the slab, reducing the thickness to a final thickness by carrying out cold rolling once or at least twice with an intermediate annealing inserted therebetween, carrying out decarburization annealing, carrying out a nitriding treatment while running the strip, coating an anneal separating agent on the strip, and subjecting the coated strip to high-temperature finish annealing.

DESCRIPTION OF THE PREFERRED EMBODIMENTS

Figure 1:
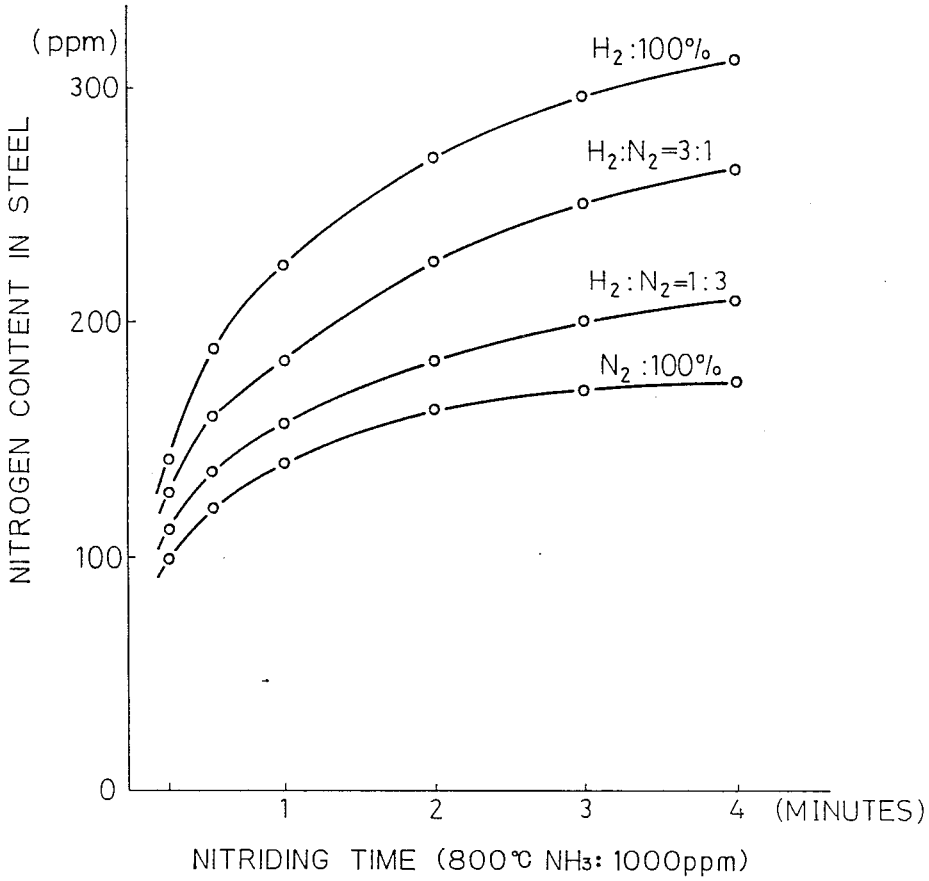
FIG. 1 shows the relationship between the nitriding time and the nitrogen content in the steel, observed when the decarburization-annealed sheet is nitrided by using various gas mixtures, and is plotted relative to the kind and amount of the gas mixture.

The constitutional requirements characterizing the present invention will now be described.

The present inventors carried out research into the development of a process for stably preparing a grain-oriented electrical steel sheet having excellent magnetic and film characteristics while controlling the temperature for heating an electrical steel slab to less than 1200° C., and found that if at the slab-heating step a solid solution of inhibitor-forming elements, such as Al, N, Mn and S, into the steel is not completed until after the decarburization annealing step, and the material is subjected to a nitriding treatment in a highly reduced atmosphere while running the strip, an inhibitor composed mainly of (Al,Si)N is formed and a glass film having an excellent adherence and appearance and no defects such as "frosting" can be formed even if the dew point of the atmosphere is not particularly limited at the finish annealing step.

The reasons for the limitations of the contents of ingredients in the electrical steel slab used as the starting material in the present invention will now be described.

If the C content is lower than 0.025%, the secondary recrystallization because unstable, and even if the secondary recrystallization is effected, the flux density (B10 value) of the product is lower than 1.80 Tesla.

If the C content exceeds 0.075%, a long time is required for the decarburization annealing, and the productivity is drastically reduced.

If the Si content is lower than 2.5%, a product having a highest watt loss characteristic, i.e., a W17/50 smaller than 1.05 W/kg at a thickness of 0.30 mm, cannot be obtained. From this viewpoint, the lower limit of the Si content is preferably 2.5%.

If the Si content exceeds 4.5%, cracking or breaking of the material often occurs at the cold rolling step, and it is impossible to obtain a stable cold rolling operation.

A characteristic feature of the composition of the starting material used in the present invention is that the S content is controlled to up to 0.012%, preferably up to 0.0070%. In the known technique, for example, the technique disclosed in Japanese Examined Patent Publication No. 40-15644 or Japanese Examined Patent Publication No. 47-25250, S is indispensable as the element for forming MnS, which is one of precipitates necessary for causing the secondary recrystallization. In this known technique, a range of the S content manifesting a highest effect is given, and the optimum content is defined to be the content capable of solid-dissolving MnS at the slab-heating step conducted before the hot rolling, but it was not known that the presence of S is detrimental to the secondary, recrystallization. The present inventors found that, in the process for preparing a grain-oriented electrical steel sheet by using (Al,Si)N as the precipitate necessary for the secondary recrystallization, if a slab having a high Si content is heated at a low temperature and hot-rolled, the presence of S causes an insufficient secondary recrystallization.

Where the Si content is up to 4.5%, if the S content is up to 0.012%, preferably up to 0.0070%, an insufficient secondary recrystallization does not occur.

In the present invention, (Al,Si)N is used as the precipitate necessary for the secondary recrystallization.

Accordingly, to maintain a lowest necessary amount of AlN, the acid-soluble Al content must be at least 0.010% and the N content exist be at least 0.0030%. If the acid-soluble Al content exceeds 0.060%, the AlN amount in the hot-rolled sleet is not appropriate and the secondary recrystallization becomes unstable.

If the N content exceeds 0.010%, a swelling, known as a "blister", occurs on the surface of the steel sheet. Moreover, if the N content exceeds 0.010%, the grain size of the primary recrystallization grains cannot be controlled.

Another characteristic feature of the composition of the starting material used in the present invention is the Mn or P. In the present invention, the Si content in the starting material is adjusted to at least 2.5%, to obtain a product having a highest watt loss characteristic. If this material having a high Si content is subjected to the low-temperature slab-heating treatment and the subsequent hot rolling, a problem of an insufficient secondary recrystallization arises. In the present invention, this problem is solved by controlling the S content to a very low level. Accordingly, the action of MnS as the precipitate for the secondary recrystallization is reduced, and therefore, the flux density of the obtained product is relatively low.

In the present invention, by controlling the Mn and P contents to appropriate levels, a product having a flux density B10 of at least 1.89 Tesla is obtained.

If the Mn content is reduced, the secondary recrystallization becomes unstable, and if the Mn content is increased, the B10 value is increased, but even if Mn is incorporated in an amount exceeding a certain level, the improvement is not further enhanced and the manufacturing cost is increased.

If the P content is too low, the B10 value of the product is small, and if the P content is too high, the frequency of cracking in the material at the cold rolling step is increased and an insufficient secondary recrystallization often occurs.

For the above-mentioned reasons, to obtain a product having a flux density B10 of at least 1.89 Tesla, cause a stable secondary recrystallization, and control cracking of the material at the rolling step, the Mn content is adjusted to 0.08 to 0.45% and the P content is adjusted to 0.015 to 0.045%.

The preparation process will now be described.

The electrical steel slab is prepared by melting steel in a melting furnace such as a converter or electric furnace, subjecting the molten steel to a vacuum degasification treatment according to need, and subjecting the molten steel to continuous casting or ingot making and blooming. Then the slab is heated prior to the hot rolling. In the process of the present invention, the slab-heating temperature is maintained at a level lower than 1200° C., to reduce the quantity of energy consumed for the heating, and AlN in the steel is not completely solid-dissolved, i.e., an incomplete solid solution state is maintained.

MnS having a higher solid-dissolving temperature is naturally in the incompletely solid-dissolved state at the above-mentioned slab-heating temperature.

After the above-mentioned heating operation, the electrical steel slab is hot-rolled, and directly or after annealing according to need, the rolled sheet is cold-rolled once or at least twice with intermediate annealing inserted therebetween, whereby the thickness is reduced to a final thickness.

In the present invention, the electrical steel slab is heated at a relatively low temperature, i.e., a temperature lower than 1200° C.

Accordingly, Al, Mn, S and the like in the steel are in the incompletely solid-dissolved state, and in this state, inhibitors manifesting the secondary recrystallization in the steel, such as (Al,Si)N and MnS, are not present. Therefore, N must be intruded into the steel to form (Al,Si)N acting as the inhibitor, before the manifestation of the secondary recrystallization.

The technique of nitriding a material of a final sheet thickness, obtained by heating a silicon steel slab at a low temperature, before the secondary recrystallization, is disposed, for example, in Japanese Examined Patent Publication No. 62-45285. Where nitriding is effected in a short time while running the strip according to the present invention, to remove the topmost barrier layer of the material, $H_2$ gas must be incorporating in a nitriding atmosphere (containing $NH_3$). Moreover, the oxidation potential at the nitriding treatment of the material is important for the secondary recrystallization at the finish annealing step.

Namely, to obtain good secondary recrystallization grains as described hereinafter, the nitriding of the steel sheet must be carried out in a dry atmosphere (gas having a low dew point).

According to the conventional process, nitriding of a steel sheet is carried out on a tight strip coil having an lamination factor of about 90%. In this tight strip coil, the sheet clearance is very narrow, i.e., less than 10 μm, and the gas permeability is very bad. Accordingly, a long time is necessary for replacing the atmosphere between the steel sheets by a dry atmosphere, and a long time is also required for the intrusion and diffusion of $N_2$ as the nitriding source between the sheets. As the means for eliminating this disadvantage, a process has been tried in which the nitriding treatment of the steel sheet is carried out on a loose strip coil. In this case, however, the problem arising when the nitriding treatment is effected on a strip coil, i.e., the problem of uneven nitriding owing to temperature unevenness in the coil, cannot be solved, and satisfactory results cannot be obtained.

To solve this problem, according to the present invention, after the decarburization annealing, the nitriding treatment of the steel sheet is carried out in an atmosphere of $NH_3$ while running the strip, to form fine (Al,Si)N acting as an inhibitor.

After the decarburization annealing, a decarburization annealing film is formed on the surface of the grain-oriented electrical steel sheet, and the nitriding is difficult, compared with the nitriding of a clean surface of a metal.

Accordingly, when in-line nitriding a steel sheet (strip), the nitriding of the steel sheet must be completed in a short time such as 30 seconds to 1 minute at a line speed of 20 to 40 m/min.

Since the nitriding treatment is carried out after the decarburization annealing, preferably the nitriding is carried out at a temperature close to the decarburization annealing temperature. Since the decarburization annealing is carried out at 800° to 850° C., in view of the cost, preferably the nitriding treatment is carried out at a temperature as close to this temperature as possible.

The present inventors carried out research into the development of a process for accomplishing the nitriding treatment of a steel sheet (strip) in a short time after the decarburization annealing, and found that the nitriding of a steel sheet depends greatly on the kind of the gas to be mixed with the $NH_3$ gas. Further research was made based on this finding, and it was found that, when the $NH_3$ gas intrudes into the steel sheet, an Fe-Si oxide having a thickness of about 200 Å formed on the topmost surface of the film formed during the decarburization annealing acts as a barrier to the intrusion of nitrogen, and if a reducing gas capable of removing this barrier layer is incorporated in the $NH_3$ gas, the steel sheet can be nitrided in a very short time. The oxidation potential is very important in this nitriding treatment, and accordingly, a dry atmosphere satisfying the requirement of $pH_2O/pH_2 \leqq 0.04$ must be maintained.

It was also found that, if the nitriding treatment is carried out under an oxidation potential exceeding this level, a thick oxide film covers the entire surface of the topmost layer of the material and has an adverse influence on the removal of the inhibitor at the subsequent finish annealing, with the result that a good secondary recrystallization is not accomplished and a fine-grain texture is formed. In a practical furnace operation, it must be taken into consideration that a large quantity of water is released from furnace wall bricks.

The relationship between the nitriding time of the steel sheet (strip) after the decarburization annealing and the nitrogen content in the steel, observed when various gases are incorporated in $NH_3$ gas, is plotted relative to the $H_2/N_2$ mixing ratio as the parameter in FIG. 1. From FIG. 1, it is seen that, as the $H_2$ ratio in the gas mixture increases, the nitriding of the steel sheet is completed in a shorter time. Where the nitriding is carried out while running the strip as in the present invention, it is necessary to complete the nitriding in a very short time, and therefore, preferably the ratio of $H_2$ in the gas mixture is at least 75%.

Note, the results shown in FIG. 1 are those obtained at an $NH_3$ concentration of 1000 ppm by volume and a nitriding treatment temperature of 800° C.

The nitriding treatment time necessary for the secondary recrystallization is at least 10 seconds, preferably at least 30 seconds. By using a specific gas to be incorporated in $NH_3$ gas, the nitriding treatment time can be shortened, and therefore, a very uniform nitriding becomes possible, a process for preparing a grain-oriented electrical steel sheet at a high productivity based on the low-temperature heating of the slab is established, and a product having an excellent glass film can be obtained.

If the $NH_3$ concentration in the $H_2$-$N_2$ gas mixture is higher than 10% by volume, the secondary recrystallization occurs, but the glass film is degraded. Therefore, the upper limit of the $NH_3$ concentration is set at 10% by volume.

In connection with the mixing ratios of $N_2$ and $H_2$ in $NH_3$ gas, preferably the ratio of $H_2$ is at least 50% by volume. If the ratio of $H_2$ is lower than this level, the formation of the inhibitor is adversely influenced, and the flux density is not increased.

Figure 2:
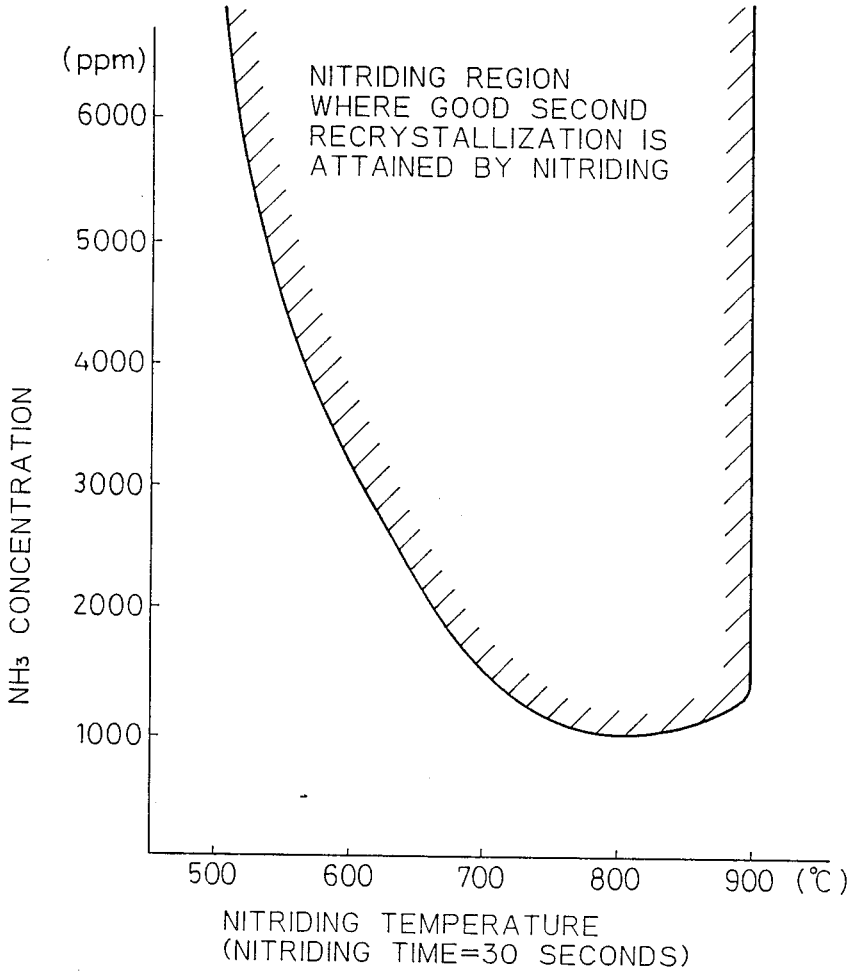
FIG. 2 shows a region wherein a sample nitrided for 30 seconds by a gas mixture comprising $H_2$ gas and $NH_3$ gas shows a good secondary recrystallization after finish annealing, and is shown relative to the nitriding temperature and $NH_3$ concentration.

The region wherein a good secondary recrystallization is manifested in a product obtained by carrying out the nitriding treatment for 30 seconds in an atmosphere of an $NH_3/H_2$ gas mixture, giving a highest intrusion of nitrogen into the steel and then carrying out the finish annealing, is plotted relative to the nitriding treatment temperature and the $NH_3$ gas concentration ($NH_3/H_2$ volume ratio) in FIG. 2. As apparent from FIG. 2, the nitriding is caused in a shortest time at a temperature of 750° to 850° C. If the temperature is higher than 900° C., an primary grain structure changes and the secondary recrystallization becomes insufficient. If the temperature is lower than 500° C., the diffusion of nitrogen in the steel becomes uneven, a good secondary recrystallization is not caused, and the flux density is degraded.

If the above-mentioned nitriding treatment is conducted on the steel sheet, only a very thin surface layer portion of the film formed by the decarburization annealing is reduced, but a sufficient amount of silica is left. Accordingly, after the finish annealing, a good forsterite film is formed on the surface of the steel sheet.

Steel sheet samples having a different nitrogen content, which have been prepared according to the above-mentioned procedures, are subjected to the finish annealing at a finish annealing temperature of up to 880° C. in a in-furnace nitriding temperature region by changing the $N_2$ gas concentration in the atmosphere (the gas other than $N_2$ is $H_2$), and then the finish annealing is carried out at a finish annealing temperature of 880° to 1200° C. under usual conditions.

Figure 3:
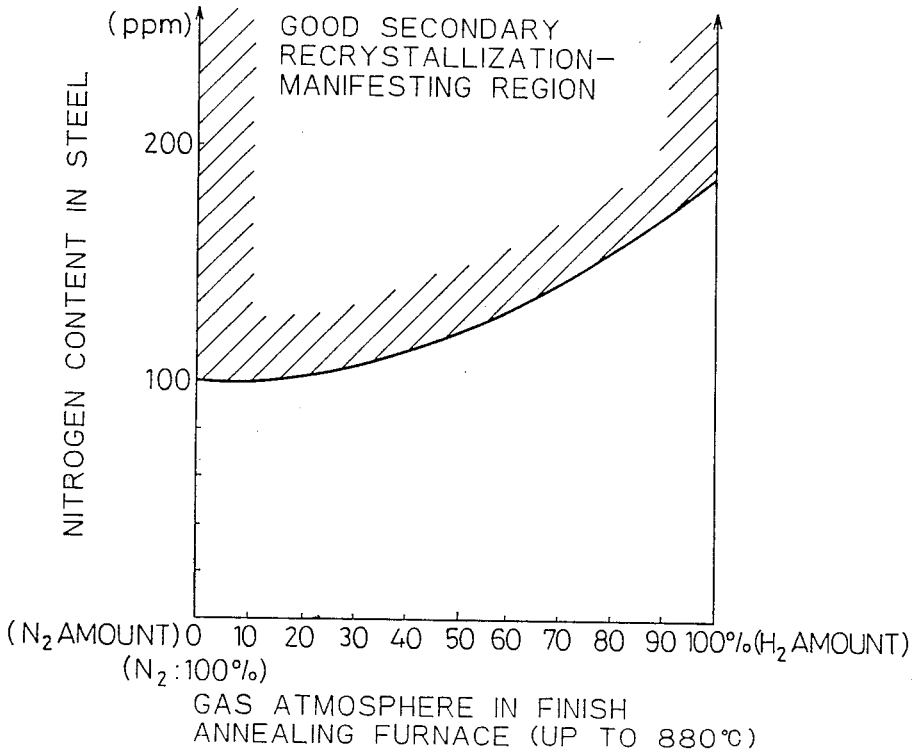
FIG. 3 shows a region giving a good secondary recrystallization, and is shown relative to the gas atmosphere in a finish annealing furnace and the nitrogen content in the steel.

The region manifesting a good recrystallization in the above operation is shown in FIG. 3. As apparent from FIG. 3, to attain a good secondary recrystallization, it is necessary that, with a reduction of the $N_2$ concentration in the finish annealing furnace, the nitrogen content in the steel is increased above the level before the finish annealing.

In the practical finish annealing of the steel sheet in the form of a tight strip coil, since the clearance between the sheet differs according to the position, the atmosphere in the furnace is different from the atmosphere between the sheets, and even if the nitriding of the steel sheet is carried out in a dry atmosphere of the $N_2/H_2$ gas mixture, often an inhibitor necessary for attaining a good secondary recrystallization is not formed.

If nitrogen is contained in an amount of at least 180 ppm in the steel, a good secondary recrystallization can be attained. Accordingly, if nitrogen is supplied into the clearance between the sheets of the strip coil from the finish annealing atmosphere, it is not absolutely necessary that nitroqen is incorporated in an amount of at least 180 ppm in the steel, but even if nitrogen is supplied in the clearance between the sheets of the strip coil from the finish annealing atmosphere, under usual finish annealing conditions, it is necessary to intrude nitrogen in an amount of at least 100 ppm into the steel by a means other than supply of nitrogen from the atmosphere gas.

According to the present invention, even if the nitriding of the steel sheet is not caused during the first half of the finish annealing process, by the nitriding treatment conducted after the decarburization annealing while running the strip, nitrogen can be easily made present in the steel in an amount of at least 180 ppm, and the secondary recrystallization can be stably effected.

By adopting the abovementioned means, the nitriding can be accomplished more stably and uniformly than by the conventional means of adding a nitrogen source into an anneal separating agent.

In addition to the above-mentioned effects, the following effect can be attained according to the present invention. In the conventional technique, the composition, dew point, and temperature of the atmosphere gas at the first half of the finish annealing step are strictly controlled. In contrast, in the present invention, since the nitriding of the steel sheet is accomplished before the finish annealing, the foregoing conditions can be freely controlled, to form a good glass film having an excellent adherence.

The adherence and tension of the glass film and the magnetic properties of the finish-annealed product obtained by adjusting the drew point of the atmosphere gas ($H_2/N_2$=75%/25%) at the first half of the finish annealing step to −20° C., −10° C., 0° C., 10° C., 20° C. or 30° C. are shown in Table 1.

It is seen in Table 1 that a product obtained under a weak oxidizing condition of 0° C., 10° C. or 20° C. has excellent film and magnetic characteristics when compared to a product obtained under a condition of −20° C. or −10° C.

As is apparent from the above description, by carrying out the nitriding treatment while running the strip, a product having excellent glass film characteristics and excellent magnetic characteristics can be obtained.

Namely, the present invention provides a superior process for the preparation of the grain-oriented electrical steel sheet, in which the nitriding of the steel sheet and the formation of the glass film, which are carried out in the finish annealing furnace in the conventional technique, are carried out separately, whereby a product having excellent magnetic characteristics and good film characteristics can be obtained.

TABLE 1

(0.23 mm in thickness)

| Dew Point | Glass Film Characteristics | Magnetic Characteristics |
|---|---|---|
| −20° C. | adherence = 10 mm, tension = 400 g/mm$^2$ | B10 = 1.93 T, watt loss W17/50 = 0.87 W/kg |
| −10° C. | adherence = 10 mm, tension = 420 g/mm$^2$ | B10 = 1.93 T, watt loss W17/50 = 0.87 W/kg |
| 0° C. | adherence = 5 mm, tension = 610 g/mm$^2$ | B10 = 1.93 T, watt loss W17/50 = 0.84 W/kg |
| 10° C. | adherence = 5 mm, tension = 700 g/mm$^2$ | B10 = 1.93 T, watt loss W17/50 0.82 W/kg |
| 20° C. | adherence = 5 mm, tension = 730 g/mm$^2$ | B10 = 1.93 T, watt loss W17/50 = 0.83 W/kg |
| 30° C. | adherence = 5 mm, tension = 630 g/mm$^2$ | B10 = 1.90 T, watt loss W17/50 = 0.93 W/kg |

Note
adherence: diameter at which peeling does not occur at 180° bending

The present invention will now be described in detail with reference to the following examples, that by no means limit the scope of the invention.

EXAMPLE 1

An electrical steel slab comprising 0.050% by weight of C, 3.2% by weight of Si, 0.07% by weight of Mn, 0.025% by weight of Al, and 0.007% by weight of S, with the balance consisting of Fe and unavoidable impurities, was heated at 1200° C. and hot-rolled to obtain a hot-rolled sheet having a thickness of 2.3 mm.

The hot-rolled sheet was annealed at 1120° C. for 3 minutes and then cold-rolled to a final thickness of 0.30 mm. Then the strip was subjected to the decarburization annealing at 850° C. for 2 minutes in an atmosphere of a gas mixture comprising 75% of $H_2$ and 25% of $N_2$, which had a dew point of 60° C., and then the strip was subjected to the nitriding treatment at 800° C. for 30 seconds in a dry atmosphere of a gas mixture comprising 75% of $H_2$ and 25% of $N_2$ and containing $NH_3$ in an amount of 1500 ppm [($NH_3$)/(75% of $H_2$+25% of $N_2$) volume ratio] ($pH_2O/pH_2$=0.01).

Subsequently, the strip was cooled, a slurry formed by adding water to an anneal separating agent was coated on the strip by a roll coater, the strip was then placed in a drying furnace, the temperature was elevated to a strip temperature of 150° C. to remove water, and the strip was wound in the form of a coil.

The strip coil was changed in a finish annealing furnace, and a usual finish annealing was carried out.

The magnetic characteristics and glass film characteristics of the obtained product are shown in Table 2.

The comparative material was obtained by nitriding the steel sheet by supplying nitrogen from nitrogen sources added to the atmosphere gas and anneal separating agent during the finish annealing.

TABLE 2

| | Comparative Steel | Steel of Present Invention |
|---|---|---|
| B10 (T) | 1.90 | 1.93 |
| W17/50 (W/kg) | 1.03 | 0.97 |
| film defect* | slight | not found |

Note
*speck-like defects having a metallic luster and glitter, where the forsterite film is not present

EXAMPLE 2

An electrical steel slab comprising 0.06% by weight of C, 3.2% by weight of Si, 0.1% by weight of Mn, 0.03% by weight of Al, and 0.008% by weight of S, with the balance consisting of Fe and unavoidable impurities, was heated at 1200° C. and hot-rolled to form a hot-rolled sheet having a thickness of 2.3 mm.

The hot-rolled sheet was annealed at 1150° C. for 3 minutes and then cold-rolled to a final thickness of 0.23 mm. Then the strip was subjected to the decarburization annealing at 830° C. for 3 minutes in an atmosphere of a gas mixture comprising 75% of $H_2$ and 25% of $N_2$ and having a dew point of 55° C., and then the strip was subjected to the nitriding treatment at 850° C. for 15 seconds in a dry atmosphere comprising 100% of $H_2$ and containing $NH_3$ in an amount of 2000 ppm [$NH_3/H_2$ volume ratio] ($pH_2O/pH_2=0.03$).

Subsequently, the strip was cooled, a slurry formed by adding water to an anneal separating agent was coated on the strip by a roll coater, the coated strip was placed in a drying furnace and the temperature was elevated to a strip temperature of 150° C. to remove water, and the strip was wound in the form of a strip coil.

Then the strip coil was charged in a finish annealing furnace, and while the temperature was being elevated to 850° C., the strip coil was maintained in an atmosphere having a dew point of 10° C., and then a dry temperature was used and the final annealing was continued.

The magnetic characteristics and glass film characteristics of the obtained product are shown in Table 3.

Note, the comparative material was prepared by nitriding the steel sheet while supplying nitrogen from the gas atmosphere in the finish annealing furnace and performing the treatment in a completely dry atmosphere during the first half of the final finishing step.

As apparent from Table 3, not only the magnetic characteristics but also the film characteristics are greatly improved in the product of the present invention.

TABLE 3

| | Comparative Steel | Steel of Present Invention |
|---|---|---|
| B10 (T) | 1.91 | 1.93 |
| W17/50 (W/kg) | 0.93 | 0.83 |
| Adherence(1) | 20 mm | 5 mm |
| Film Tension | 410 g/mm$^2$ | 730 g/mm$^2$ |
| Film Defect(2) | slight | not found |

Note
(1)diameter at which peeling does not occur at 180° bending
(2)speck-like defects having a metallic luster and glitter, where the forsterite film is not present As apparent from the foregoing description, according to the present invention, since the nitriding treatment of the steel sheet, which is conducted in the finish annealing furnace in the conventional technique, is carried out before the finish annealing while running the strip, an epoch-making effect of improving both the magnetic characteristics and the glass film characteristics can be attained, and accordingly, the present invention has a very high industrial value.

We claim:

1. A process for the preparation of a grain-oriented electrical steel sheet having excellent magnetic characteristics and film characteristics, which comprises heating an electrical steel slab comprising 0.025 to 0.075% by weight of C, 2.5 to 4.5% by weight of Si, up to 0.012% by weight of S, 0.010 to 0.060% by weight of acid-soluble Al, up to 0.010% by weight of N, 0.08 to 0.45% by weight of Mn, and 0.015to 0.045% by weight of P, with the balance consisting of Fe and unavoidable impurities, at a temperature lower than 1200° C., hot-rolling the slab, reducing the thickness to a final thickness by carrying out cold rolling once or at least twice with an intermediate annealing inserted therebetween, completing a primary recrystallization by carrying out decarburization annealing, then carrying out a nitriding treatment and simultaneously running the strip at a temperature of 500° to 900° C. for 15 to 60 seconds in an atmosphere having a $HN_3$ gas concentration which is 1000 ppm to 10% and a mixing ratio of $H_2$ gas to $N_2$ gas which is at least 50%, coating an anneal separating agent on the strip, and subjecting the coated strip to high-temperature finish annealing.

2. A process according to claim 1, wherein the high-temperature finish annealing is carried out in a weak oxidizing atmosphere at a temperature of 600° to 850° C.

3. A process according to claim 2, wherein nitrogen is made present in the steel such that nitrogen is present in an amount of at least 100 ppm just before the step of high-temperature finish annealing is carried out.

4. A process according to claim 2, wherein nitrogen is made present in the steel such that nitrogen is present in an amount of at least 180 ppm just before the step of high-temperature finish annealing is carried out.

5. A process according to claim 1, wherein the nitriding treatment is carried out in an atmosphere in which the oxidation potential $pH_2O/pH_2$ is up to 0.04.

* * * * *